United States Patent [19]

Namdari et al.

[11] 4,421,251

[45] Dec. 20, 1983

[54] MOTORIZED APPARATUS FOR DISPENSING CAKE ICING

[76] Inventors: Bahram Namdari; Kathleen D. Namdari, both of P.O. Box 17366, Milwaukee, Wis. 53217

[21] Appl. No.: 307,186

[22] Filed: Oct. 1, 1981

[51] Int. Cl.[3] ..... B65D 35/28

[52] U.S. Cl. ..... 222/99; 222/104; 222/325; 222/333; 318/305

[58] Field of Search ..... 222/93, 101, 102, 98, 222/106, 107, 104, 99, 100, 325, 333, 95, 97; 118/13; 318/305

[56] References Cited

U.S. PATENT DOCUMENTS

| | | | |
|---|---|---|---|
| 1,515,215 | 2/1923 | King | 318/305 |
| 2,723,779 | 11/1955 | Parker et al. | 222/107 |
| 3,581,943 | 6/1971 | Koenigshof et al. | 222/102 |
| 3,984,033 | 10/1976 | Groth et al. | 222/333 |
| 4,132,330 | 1/1979 | Rauscher et al. | 222/100 |
| 4,136,801 | 1/1979 | Pauenick | 222/95 |

*Primary Examiner*—Joseph J. Rolla
*Assistant Examiner*—Frederick R. Handren
*Attorney, Agent, or Firm*—Andrus, Sceales, Starke & Sawall

[57] ABSTRACT

Motorized apparatus for dispensing cake icing comprises a hand-held power unit including a multi-speed electric motor and controls, including a trigger switch, for the motor, one or more cartridges detachably connectable to the power unit and each including a rotatable member drivable by the motor, and a collapsible icing bag having a nozzle and containing icing, such bag being detachably connectable to the rotatable member and windable or twistable by the rotatable member so that icing is extruded from the nozzle. The controls operate to cause momentary motor reversal to stop icing extrusion when the trigger switch is released. Each cartridge includes a device to prevent unwinding or untwisting of the bag when the cartridge is removed from the power unit.

16 Claims, 20 Drawing Figures

MOTORIZED APPARATUS FOR DISPENSING CAKE ICING

BACKGROUND OF THE INVENTION

1. Field of Use

This invention relates generally to motorized apparatus for dispensing cake icing or the like.

2. Description of the Prior Art

Presently, decorative icing or frosting is usually applied to a cake from a hand-held conicallyshaped open-topped flexible bag having a hollow tip or nozzle at its lower end. Typically, several bags, one for each type or color of icing required, are at hand. In use, the bag is first filled with icing through its open top and then the user, holding the top of the bag closed with one hand while aiming the nozzle with the other hand, applies a squeezing or twisting motion to the bag thereby causing the icing to be extruded or expelled through the nozzle at a desired rate of flow. Such manual application of icing is strenuous and tiring. U.S. Pat. Nos. 2,320,496; 2,099,412; and 2,723,779 show typical prior art manually operated icing dispenser bags. In so far as applicants are presently aware, the prior art does not include any type of motor powered apparatus for dispensing cake icing, although some prior art patents such as the following show various forms of equipment for extruding flowable substances such as tooth paste, caulking compounds or other substances: U.S. Pat. No. 4,132,330; 3,581,943; 3,738,533; 3,187,951; 3,302,832.

SUMMARY OF THE PRESENT INVENTION

In accordance with the present invention there is provided improved motorized apparatus for dispensing cake icing. The apparatus comprises a hand-held power unit including a multi-speed battery or line-cord powered electric motor and control means therefor; one or more cartridges detachably connectable to the power unit and each including a rotatable member drivable by the motor; and a flexible open-topped (closable) collapsible icing container or bag having a nozzle at its lower end, such bag being detachably connectable to the rotatable member and windable or twistable as the member rotates so that icing is extruded from the nozzle. In practice, one cartridge and bag therefor is provided for each type or color of icing required for a particular job.

The power unit further includes a housing and a speed reduction gear assembly therein for reducing motor speed from a relatively high rpm (typically about 4000 rpm) to the relatively low rpm range required for the roller member to effect bag winding or twisting (typically about 25 rpm). The gear reduction assembly includes a power take-off means, such as a rotatable drive shaft, which is detachably connectable to the rotatable member on the cartridge.

The control means on the power unit includes a selector switch and a trigger switch whereby the motor can be selectively operated at one of several constant speed ranges or in trigger-controlled variable speed range. The control means also includes circuitry whereby motor rotation is momentarily reversed after motor stoppage occurs so that bag pressure and unwanted icing extrusion is prevented when the icing extrusion is to be instantly stopped.

The cartridge further includes means whereby it is releasably connectable to the housing of the power unit and the cartridge roller member includes means whereby it is releasably connectable to the power take-off means on the power unit. The cartridge also includes latch means to prevent rotational movement of the roller member and unwinding (or untwisting) of the bag when the cartridge is removed from the power unit. In one embodiment the cartridge also includes a pair of detachable spaced-apart extrusion members, such as extrusion rollers, between which the upper portion of the bag extends to effect icing extrusion as the bag is wound in response to rotation of the roller member.

In the first embodiment of the invention the cartridge is constructed so that the bag is wound directly on the roller member and the latter is provided with a releasable bag attachment bar.

In a second embodiment of the invention the cartridge is constructed so that the roller member drives a plate which rotates around an axis which is transverse to that of the roller member and the plate are provided with a releasable bag attachment disc. In the second embodiment the bag is of a type which is twisted rather than rolled, and therefore the bag nozzle is provided with a hand-held anti-slip gripping ring whereby nozzle rotation is more easily prevented.

In a third embodiment of the invention the cartridge is constructed so that the roller member drives, through a gear train, a larger secondary roller on which a larger bag is wound.

Motorized apparatus for dispensing cake icing or the like offers numerous advantages over the prior art. For example, present cake decorating devices are primitive and manually operable and require strenuous use of the hands and arms; whereas with the present invention cake decorating becomes easy and more efficient and can be done with a touch of the finger.

The provision of various types or embodiments of cartridges in accordance with the invention enable use of the various forms and sizes of icing bags already on the market i.e., such as conically shaped cloth or plastic bags which can be rolled or twisted and specialized bags which can only be twisted.

Several types or colors of icing are usually employed on one cake decorating job and the present invention facilitates such practice by providing for one type of icing in each bag and one bag for each easily and quickly loaded cartridge, although one cartridge could accommodate successive bag attachment if necessary.

Furthermore, the cartriges are designed so that when removed from the power unit and placed on a table or counter with icing therein, the bag cannot unroll or untwist. Similarly, provision is made to relieve pressure from the icing bag when rotational or twisting motion is stopped while the cartridge is in the power unit so that icing will not ooze out.

The user also has a choice of speeds and forms of speed control in applying the icing.

Other objects and advantages of the invention will hereinafter appear.

DRAWINGS

DESCRIPTION OF PREFERRED EMBODIMENTS

Referring to FIGS. 1 through 8 and 14 there is shown improved motorized cake icing apparatus in accordance with a first embodiment of the invention and including a hand-held power unit 10, a cartridge 12 for detachable connection to the power unit, and a collapsible icing container or bag 14 for detachable connection to the cartridge.

Figure 1:
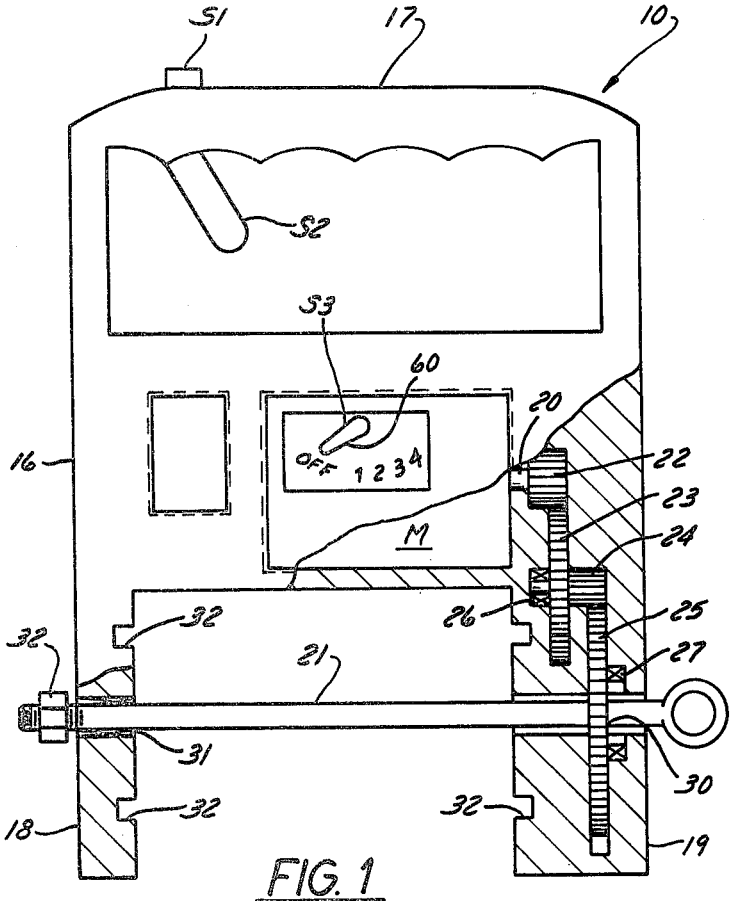
FIG. 1 is a side elevation view, partly in crosssection, of the power unit of an icing dispensing apparatus in accordance with the invention.
Figure 2:
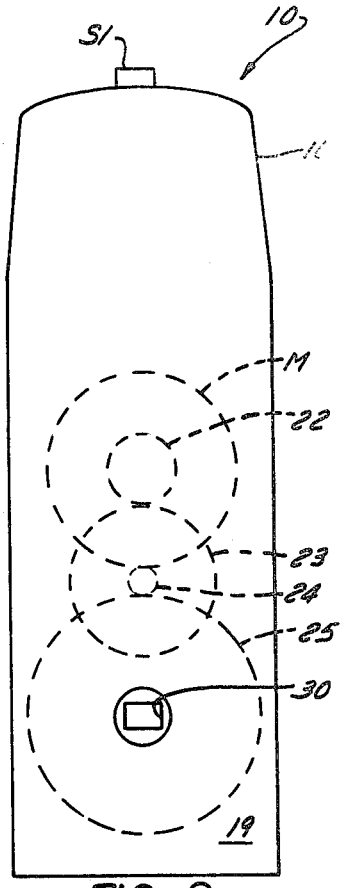
FIG. 2 is an end view of the unit of FIG. 1.

As FIGS. 1 and 2 show, power unit 10 comprises a housing 16, preferably formed of molded plastic, which includes a handle 17 and a lower portion including spaced apart front and rear walls 18 and 19, respectively, between which cartridge 12 is receivable. Within housing 16 are located an electric motor M, a battery B for powering the motor, switches S1, S2, S3 and control circuitry for controlling the motor, and a speed reduction gear assembly for connecting motor shaft 20 to effect rotation of a power take-off means such as a rotatable drive shaft 21.

The gear assembly includes a small gear 22 fixedly mounted on motor shaft 20, a large gear 23 which meshes therewith and has a smaller gear 24 fixedly mounted thereon, and a large gear 25 which meshes with gear 24. Gears 23 and 25 are provided with bearings 26 and 27, respectively, by means of which they are rotatably mounted on housing 16. Gear 25 is provided with a rectangular hole 30 for receiving and supporting one end of shaft 21 which has a rectangular cross section. The other end of shaft 21 is rotatably supported in a bearing 31 in the front wall 18 of housing 16. Shaft 21 is understood to be removable when the nut 32 on the threaded end thereof is removed so that cartridge 12 can be attached or detached to or from power unit 10.

Figure 3:
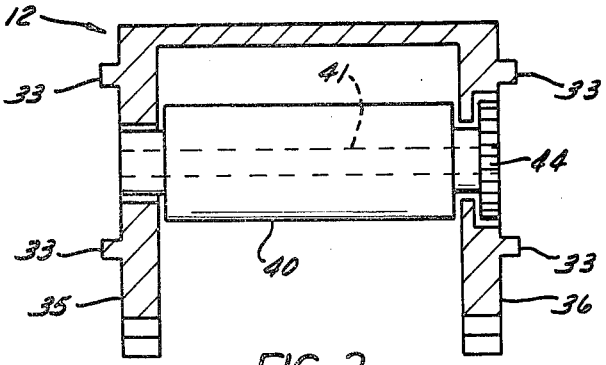
FIG. 3 is a cross section view taken on line 3—3 of FIG. 4 of one type of cartridge for releasable connection to the power unit.
Figure 4:
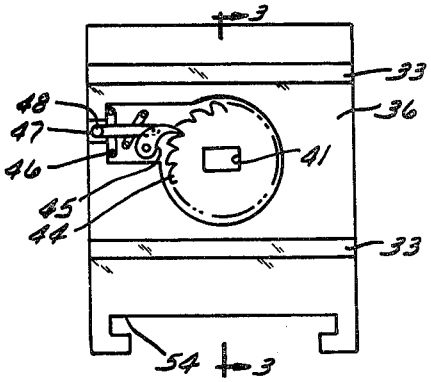
FIG. 4 is an end view of the cartridge of FIG. 3.

As FIG. 1 shows, housing 16 of unit 10 is provided with means whereby cartridge 12 is detachably connectable thereto and such means take the form of horizontal slots 32 provided on the inside surface of the front and rear walls 18 and 19, respectively, of the housing. The slots 32 slidably receive the projections 33 which are provided on the front and rear walls 35 and 36, respectively, of cartridge 12, as FIGS. 3 and 4 show.

Figure 15:
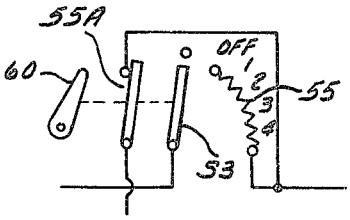
FIG. 15 is an enlarged diagram of a portion of the circuit of FIG. 14.
Figure 14:
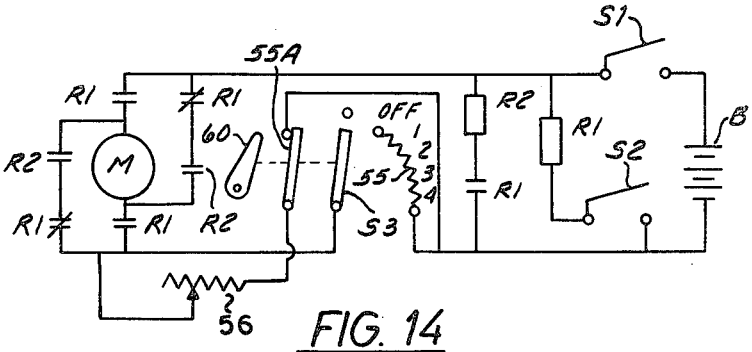
FIG. 14 is a schematic circuit diagram of the motor control for the motor of the power unit of FIG. 1.
Figure 16:
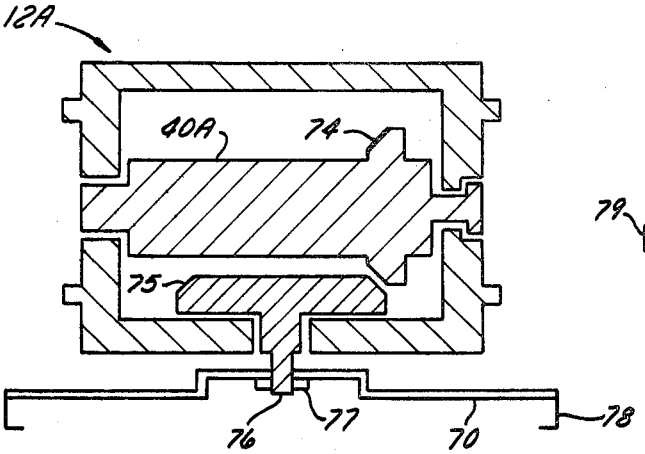
FIG. 16 is an enlarged cross section view of the cartridge shown in FIG. 9.
Figure 19:
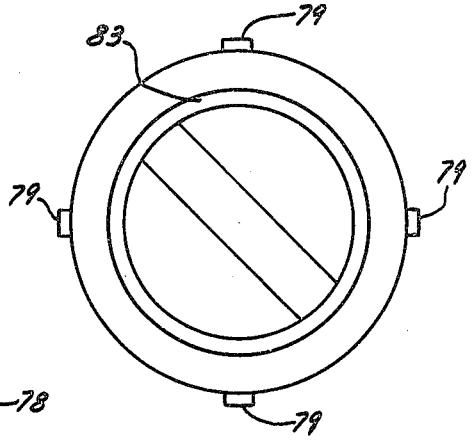
FIG. 19 is a plan view of a ring insertable into the plate of FIG. 18, which ring forms the top of the bag of FIG. 11.

As FIGS. 1 and 14 show, power unit 10 is provided with an on-off switch S1 on top of handle 17 and a spring-biased off-on-variable speed trigger switch S2 below the handle 17. Power unit 10 also includes a speed range selector switch S3 which is mounted on the side of housing 16 of unit 10. In operation, when switch S1 is turned on, and trigger switch S2 is closed, relay coil R1 is energized from battery B and causes three of its five relay contacts R1 to close (and two to open), and energizes motor M and, also, energizes a time delay relay coil R2. Energization of relay coil R2 causes its two relay contacts to close and to remain closed until a short interval of time after relay coil R2 is deenergized as a result of opening of trigger switch S2 and deenergization of relay coil R1. As a result, when switch S2 opens, motor M is momentarily connected for reverse polarity from battery B and momentarily runs in reverse. This relieves any pressure on bag 14 and prevents icing from oozing therefrom, as hereinafter explained, after trigger switch S2 is released. A rheostat 56 is connected in series circuit between motor M and battery B and is operable, provided a switch 55A is closed, as trigger switch S2 is depressed to effect speed variations in motor M. Switch 55A is closed whenever selector switch S3 is placed in off position. Selector switch S3 is movable from its off position (thereby causing switch 55A to open) to any one of several speed range positions (such as 1, 2, 3, 4) as its wiper moves across a second rheostat 55. As FIG. 15 shows, switch S3 and rheostat 55 may be constructed to have a mechanical interconnection with each other whereby manipulation of one movable switch member 60 effects a switching as well as a rheostatic function. Thus, the user has a choice of either having one of several continuous speeds, or a variable speed.

Referring again to FIGS. 3 and 4, it is seen that the cartridge 12 includes the means 33 whereby it is releasably connectable to the housing 16 of the power unit 10 and further includes a cartridge roller member 40 which includes means, such as a bore 41 therethrough, whereby it is releasably connectable to the power take-off shaft 21 on the power unit 10. In use, nut 32 is unscrewed from shaft 21 and the latter is pulled out and cartridge 12 is loaded, whereupon shaft 21 is replaced and secured by nut 32.

The cartridge 12 also includes latch means to prevent rotational movement of the roller member 40 and unwinding of the bag 14 when the cartridge 12 is removed from the power unit 10. The latch means, best seen in FIG. 4, include a ratchet wheel 44 rotatable with roller member 40 and a pivotal pawl 45 which is biased into engagement with the ratchet wheel 44 by a biasing spring 46 whenever cartridge 12 is removed from power unit 10. This prevents the roller member 40 from rotating and unrolling bag 14 when cartridge 12 is removed from the power unit 10. Pawl 45 is movable out of engagement with ratchet wheel 44 by means of a rod or pin 47 which is connected to the pawl 45 whenever a hook 48 on the end of pin 47 engages housing 16 as cartridge 12 is inserted into position on power unit 10. If preferred, some other form of latch means could be employed.

Figure 6:
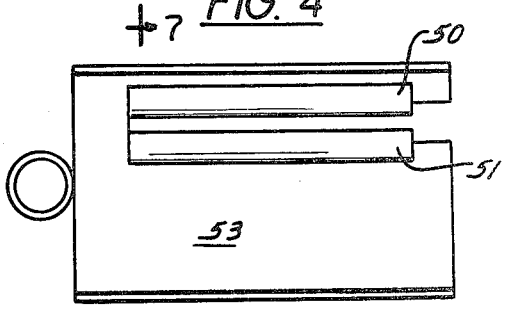
FIG. 6 is a plan view of an extruder roller support plate which is slidably mountable on the cartridge of FIGS. 3 and 4.
Figure 7:
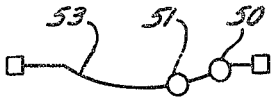
FIG. 7 is a cross section view taken on line 7—7 of FIG. 6.
Figure 8:
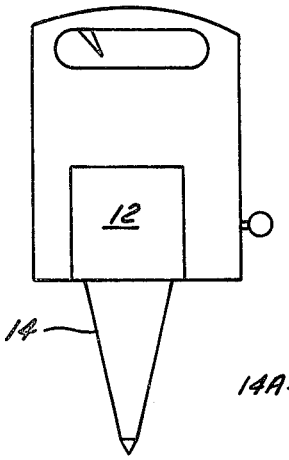
FIG. 8 is a side elevation view in reduced scale of a first embodiment of the invention including the power unit of FIGS. 1 and 2, the cartridge of FIGS. 3 and 4 mounted thereon, and an icing bag.
Figure 9:
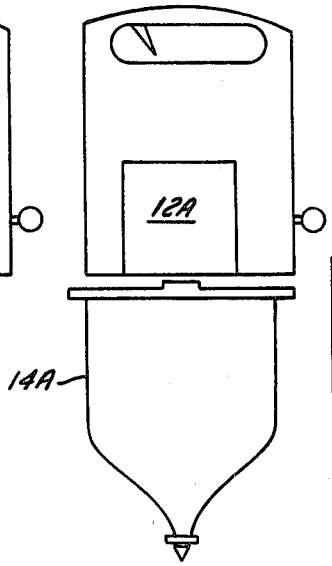
FIG. 9 is a view similar to FIG. 8 of a second embodiment of the invention employing another form of cartridge and bag.
Figure 10:
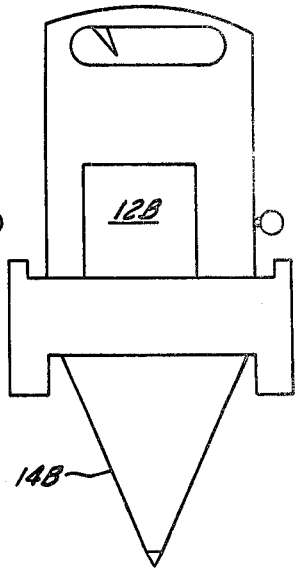
FIG. 10 is a view similar to FIG. 8 of a third embodiment of the invention employing still another form of cartridge and bag.

The cartridge 12 also includes a pair of detachable spaced-apart extrusion members, shown in FIGS. 6 and 7, such as extrusion rollers 50 and 51, mounted on a plate 53 between which the upper portion of the bag 14 extends to effect icing extrusion as the bag is wound in response to rotation of the roller member 40.

After icing bag 14 has been loaded on the cartridge 12 this plate 53 is inserted in the slit 54 on the cartridge so that the bag 14 is placed between rollers 50 and 51. The distance between these two rollers is chosen so that it will allow loading of the plate 53 on the cartridge 12 to be practical, but close enough together to prevent the icing in the bag from oozing upward.

Figure 5:
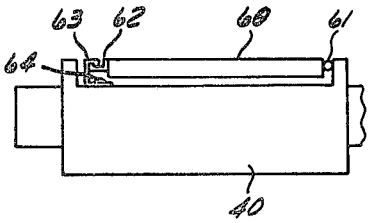
FIG. 5 is an enlarged elevation view, with portions broken away, of a releasable bag attachment bar for the roller member of FIG. 3.

In the first embodiment of the invention the cartridge 12 is constructed so that the bag 14 is wound directly on the roller member 40 and the latter is provided with a releasable bag attachment bar assembly shown in FIG. 5. This assembly includes a plate 68 that pivots at one end on a hinge pin 61 and has a latch hook 62 at its other end which engages a resilient S-shaped latch member 63 which is rigidly secured to roller member 40 as by a screw 64. When plate 68 is unlatched from member 63, the top of bag 14 is inserted between roller member 40 and plate 68, whereupon the latter is then latched. As the member 40 rotates, the bag 14 winds therearound and holds plate 68 down against member 40. Bag 14 is removed when empty by first unrolling it and then moving latch member 63 from hook 62 so that plate 68 can be raised and the bag top freed.

In a second embodiment of the invention shown in FIGS. 9, 11, 12, 13, 16, 17, 18, 19, the cartridge 12A is constructed so that the roller member 40A drives a plate 70 which rotates around an axis which is transverse to that of the roller member 40A and the plate 70 is provided with releasable bag attachment flanges 78. In the second embodiment the bag 14A is of a type which is twisted rather than rolled, and therefore the bag nozzle 72 is provided with a hand-held anti-slip gripping ring 73 whereby nozzle rotation is more easily prevented. In cartridge 12A roller member 40A includes a gear portion 74 which engages another gear portion 75 which has a threaded shaft 76 to which plate 70 is releasably secured by a nut 77. As FIGS. 11, 18 and 19 make clear, plate 70 has four flanges or lips 78 which engage the four projections 79 on the lid 83 of bag 14A when the latter is turned a few degrees and the projections 79 come to rest against the stops 80. The upper portion of bag 14A has ribs or indentations 81 which give it some stiffness or rigidity so that the bag will only twist below the ribs 81 shown in FIG. 11 when icing extrusion is being effected. Bag 14A has a firm upper rim 82 and after icing is inserted in the bag the lid 83 is screwed thereonto.

Figure 12:
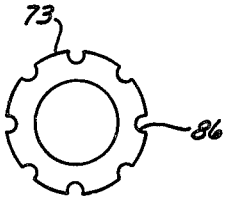
FIG. 12 is a plan view of the device of FIG. 11.

Bag 14A is provided at its lower end with an antitwist manually grippable coupler ring 73 so that the user can get a good grip on the bag. Indentations 86 are provided on the edge of the coupler ring 73, as FIG. 12 shows, and these cooperate with a member 90, shown in FIG. 13, to prevent untwisting of bag 14A when cartridge 12A is removed from power unit 10. More specifically, the flexible cord or wire 91 of member 90 is provided with beads 92 which engage the indentation 86 on ring 73 and an indention 93 in plate 70. With each end of member 90 so anchored, untwisting of the lower end of bag 14A relative to the upper end is prevented.

Figure 17:
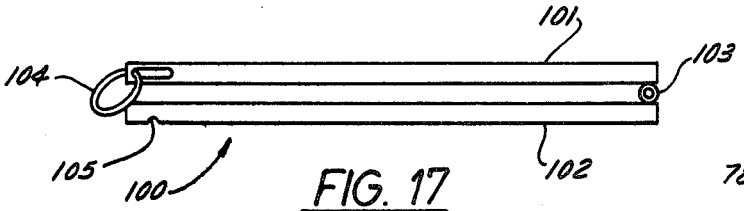
FIG. 17 is a view of a clamp for closing a bag top and enabling its connection to the cartridge in FIG. 16.
Figure 18:
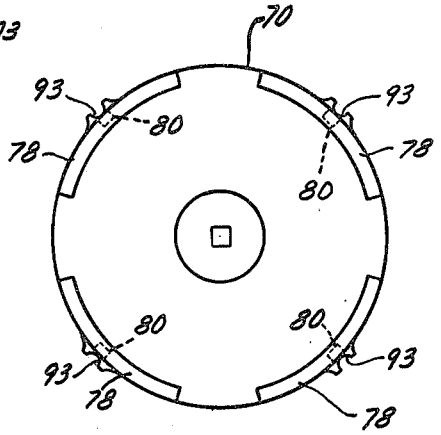
FIG. 18 is a bottom plan view of the plate shown in FIG. 16.

FIG. 17 shows a clamping device 100, including two bars or rods 101 and 102 connected together at one end by a hinge 103 and releasably connectable at the opposite end by a flexible loop of wire or ring 104. Device 100 enables a conventional icing bag such as 14 (as distinguised from bag or container 14A) to be used with cartridge 12A. The top of the bag is clamped between the rods 101 and 102 and secured by wire 104 which engages groove 105 and then the device 100 is engaged to the plate 70 shown in FIGS. 16 and 18 with an inserting and twisting motion.

Figure 20:
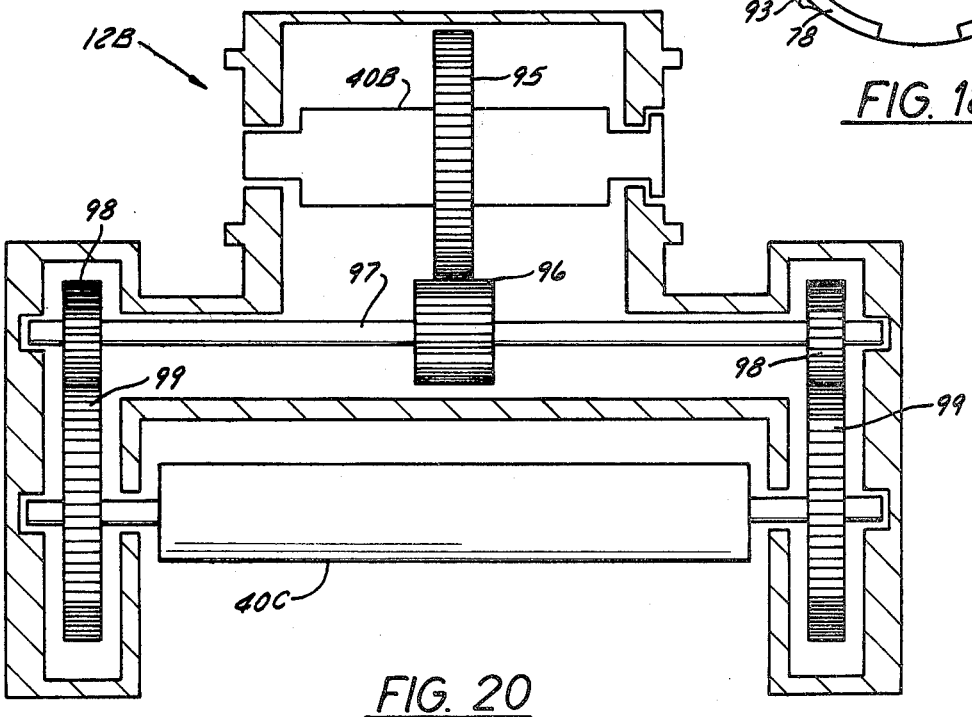
FIG. 20 is an enlarged cross section view of the cartridge shown in FIG. 10.

In a third embodiment of the invention shown in FIG. 20 the cartridge 12B is constructed so that the roller member 40B drives, through a gear train, a larger secondary roller 40C on which a larger bag 14B is wound. The gear train includes a gear 95 fixed on member 40B which meshes with a gear 96 fixed on a shaft 97. Two gears 98 on shaft 97 mesh with gears 99 fixed on roller 40C. Roller 40C is understood to be provided with a plate such as plate 68 shown in FIG. 5 and its associated components for holding the bag 14B on roller member 40C.

It is to be understood that cartridges such as 12B can be made in various sizes so that the roller 40C thereof can accomodate bags 14B which are commercially available in various sizes.

Figure 11:
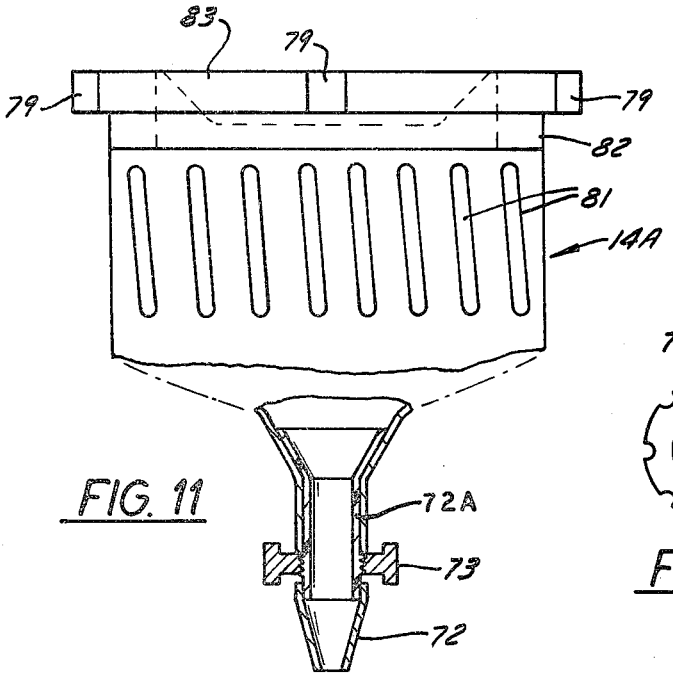
FIG. 11 is an enlarged view of the bag of FIG. 9 and showing an anti-slip device thereon.
Figure 13:
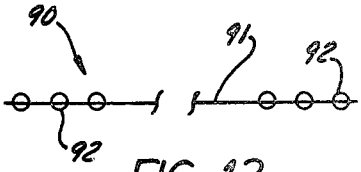
FIG. 13 is a view of a chain-like member used with the device of FIGS. 11 and 12.

It is also to be understood that with respect to the cartridge 12A that the plate 70 can be made in various sizes to accomodate bags 14A of various sizes. Nut 77 is removable to allow replacement of plates 70 of various sizes, as well as to allow plate removal for cleaning. Furthermore, as FIG. 11 shows, the bag 14A is furnished with a removable funnel-like plastic member 72A having external threads to which the ring member 73 is attached and the nozzle 72 is removable, being friction-fitted to the lower end of the member 72A. Member 72A affords additional internally supported gripping area at the lower end of bag 14A which the user may grasp to prevent bag tip rotation.

We claim:

1. Apparatus for dispensing a substance such as cake icing or the like from a collapsible container having a nozzle thereon comprising:

a hand-holdable power unit including an electric motor;

a cartridge detachably connectable to said power unit, said cartridge including a rotatable member adapted to be rotatably driven by said motor when said cartridge is connected to said power unit; and means for connecting said container to said rotatable member so that said substance is extruded from said nozzle when said member rotates, said container is wound on said rotatable member as the latter rotates and spaced-apart extrusion members on either said power unit or said cartridge between which said container is extendable and against which said container is drawn by said rotatable member to effect extrusion of said substance from said nozzle.

2. Apparatus according to claim 1, further comprising manually operable means for varying the speed of rotation of said rotatable member to thereby vary the rate of extrusion of said substance from said nozzle.

3. Apparatus according to claim 1, wherein said power unit includes means to effect momentary reverse rotation of said rotatable member after forward rotation of the latter is stopped so as to prevent oozing of said substance from said nozzle.

4. Apparatus according to claim 1, wherein said cartridge includes means to prevent rotation of said rotatable member thereof relative to said container when said cartridge is detached from said power unit.

5. Apparatus according to claim 1, wherein said power unit includes control means for said electric motor, said control means including a speed switch and a selector switch having at least one constant speed position for said motor and a variable speed position wherein manipulation of said speed switch effects variations in motor speed.

6. Apparatus for dispensing a substance such as cake icing or the like from a collapsible container having a nozzle thereon comprising:

a hand-holdable power unit including an electric motor;

a cartridge detachably connectable to said power unit, said cartridge including a rotatable member adapted to be rotatably driven by said motor when said cartridge is connected to said power unit; and means for connecting said container to said rotatable member so that said substance is extruded from said nozzle when said member rotates, said cartridge includes another member rotatably driven by said rotatable member, said container is connectable to said other member, and said other member is a secondary roller larger than said rotatable member.

7. Apparatus according to claim 6, further comprising manually operable means for varying the speed of rotation of said rotatable member to thereby vary the rate of extrusion of said substance from said nozzle.

8. Apparatus according to claim 6, wherein said power unit includes means to effect momentary reverse rotation of said rotatable member after forward rotation of the latter is stopped so as to prevent oozing of said substance from said nozzle.

9. Apparatus according to claim 6, wherein said cartridge includes means to prevent rotation of said rotatable member thereof relative to said container when said cartridge is detached from said power unit.

10. Apparatus according to claim 6, wherein said power unit includes control means for said electric motor, said conftrol means including a speed switch and a selector switch having at least one constant speed position for said motor and a variable speed position wherein manipulation of said speed switch effects variations in motor speed.

11. Apparatus for dispensing a substance such as cake icing or the like from a collapsible container having a nozzle thereon comprising:

a hand-holdable power unit including an electric motor;

a cartridge detachably connectable to said power unit, said cartridge including a rotatable member adapted to be rotatably driven by said motor when said cartridge is connected to said power unit; and means for connecting said container to said rotatable member so that said substance is extruded from said nozzle when said member rotates, said cartridge includes another member rotatably driven by said rotatable member on an axis which is transverse to the axis of said rotatable member, said container is connectable to said other member, and said other member is a plate for twisting said container.

12. Apparatus according to claim 11, further comprising manually operable means for varying the speed of rotation of said rotatable member to thereby vary the rate of extrusion of said substance from said nozzle.

13. Apparatus according to claim 11, wherein said power unit includes means to effect momentary reverse rotation of said rotatable member after forward rotation of the latter is stopped so as to prevent oozing of said substance from said nozzle.

14. Apparatus according to claim 11, wherein said cartridge includes means to prevent rotation of said rotatable member thereof relative to said container when said cartridge is detached from said power unit.

15. Apparatus according to claim 11, wherein said power unit includes control means for said electric motor, said control means including a speed switch and a selector switch having at least one constant speed position for said motor and a variable speed position wherein manipulation of said speed switch effects variations in motor speed.

16. Apparatus according to claim 11, further including an anti-slip device attached to said nozzle, said anti-slip device including a manually holdable ring extending radially from said nozzle.

* * * * *